US005709486A

United States Patent [19]

Day

[11] Patent Number: 5,709,486

[45] Date of Patent: Jan. 20, 1998

[54] PRINTING DEVICE CONSTRUCTION

[75] Inventor: Robert Charles Lewis Day, Fulbourn, United Kingdom

[73] Assignee: Esselte N.V., Belgium

[21] Appl. No.: 674,950

[22] Filed: Jul. 3, 1996

[30] Foreign Application Priority Data

Jul. 4, 1995 [GB] United Kingdom ..... 9513532

[51] Int. Cl.[6] ..... B41J 35/28

[52] U.S. Cl. ..... 400/208; 400/613; 400/692; 101/288

[58] Field of Search ..... 400/208, 120.01, 400/613, 208.1, 691, 692, 693, 693.1; 101/288

[56] References Cited

U.S. PATENT DOCUMENTS

| | | | |
|---|---|---|---|
| 4,832,514 | 5/1989 | Basile | 400/120 |
| 5,106,216 | 4/1992 | Kim | 400/185 |
| 5,184,902 | 2/1993 | Harada et al. | 400/185 |
| 5,193,919 | 3/1993 | Godo et al. | 400/120 |
| 5,306,097 | 4/1994 | Kaneko | 400/208 |
| 5,411,339 | 5/1995 | Bahrabadi et al. | 400/208 |
| 5,418,552 | 5/1995 | Maruyama | 400/208 |
| 5,419,643 | 5/1995 | Matsuura | 400/208 |

FOREIGN PATENT DOCUMENTS

| | | |
|---|---|---|
| 0 598 418 A2 | 7/1990 | European Pat. Off. . |
| 0 497 352 A2 | 1/1992 | European Pat. Off. . |
| 0 512 168 A1 | 11/1992 | European Pat. Off. . |
| 0 578 372 A2 | 6/1993 | European Pat. Off. . |
| 0 598 600 A2 | 11/1993 | European Pat. Off. . |
| 04181580 | 6/1992 | Japan . |
| 2 192 591 | 1/1988 | United Kingdom . |

*Primary Examiner*—Christopher A. Bennett
*Attorney, Agent, or Firm*—Pennie & Edmonds

[57] ABSTRACT

The present invention relates to a printing device having a baseplate with a flat base portion and upstanding elements. The flat base portion and upstanding elements are provided as a unitary part which may be formed from die casting, injection molding, outsert molding, or similar construction techniques.

20 Claims, 4 Drawing Sheets

PRINTING DEVICE CONSTRUCTION

FIELD OF THE INVENTION

The present invention relates to printing device construction, and particularly to the construction of label printers. More particularly, the present invention relates to a printing device having a unitary baseplate to provide a lower cost, more reliable construction.

BACKGROUND

Label printers are known which include a keyboard for entering data to define an image to be printed, a display for assisting a user in composing a label to be printed and a printing mechanism for printing the image onto an image receiving tape. The label printer includes a cassette receiving bay which holds a cassette. The cassette contains at least the image receiving tape and may also include a thermal transfer ribbon which is located in overlap with the image receiving tape at a print zone defined by a printing mechanism. The printing mechanism comprises a rotatable platen and a thermal printhead which cooperate to print an image. The image is printed by selectively activating printing elements of the printhead to heat them and cause transfer of ink from the thermal transfer tape to the image receiving tape, the latter of which is supported by the platen. Rotation of the platen causes the image receiving tape to move through the print zone so that images are printed by the thermal printhead on a column by column basis as the image receiving tape moves through the print zone.

A cutter assembly is typically provided for cutting off a portion of the tape. This forms the individual labels after the text has been printed.

These label printers have, in the cassette receiving bay, cassette support pins for supporting a cassette so that the image receiving tape is held at a predetermined location relative to the printing mechanism to properly align a printed image relative to the tape. The cassette receiving bay also has other locating and supporting elements, particularly for locating and supporting the printhead and platen. At present, to provide these elements, a flat steel plate is machined to include a plurality of apertures within which pins are located. Some of the pins are also made of steel and are machined separately. Some pins, such as the cassette support pins, are made of plastic. The pins must be secured in the apertures as a separate operation. Not only is such an operation difficult to automate, but, whether done automatically or manually, it frequently results in pins which are not square to the flat steel plate or parallel to each other. This means that it is difficult to control the position of the printhead relative to the image receiving tape held in a cassette to within acceptable limits.

Furthermore, it is difficult to control the print head position relative to the platen, and the straightness, parallelism and diameter of the pins supporting the printhead and platen. Thus, it is desirable to provide for accurate positioning of the elements on the baseplate with improved control over the accuracy of dimensions, such as pin diameter, across large batches of mass-produced components.

SUMMARY OF THE INVENTION

Accordingly, the present invention relates to an improvement in a printing device which includes a printer, a printing substrate support and a printing substrate advancement means. The improvement generally comprises incorporating in the printing device a baseplate having a substantially flat base portion and a plurality of upstanding elements which are positioned at predetermined locations on the base portion, where the flat base portion and plurality of upstanding elements are, together, a single part formed of a unitary construction. The unitary construction may be accomplished by any suitable process, but it is particularly advantageous to manufacture the baseplate by die casting or injection molding. Also, the baseplate can be made by coating a flat plate with a coating material that forms the upstanding elements.

The printer generally comprises a printhead with the printing substrate support being a rotatable platen. Thus, the plurality of upstanding elements may include a platen support element for receiving the rotatable platen and a printhead support element for supporting the printhead. The printing substrate generally comprises a recording medium upon which an image may be printed with the recording medium housed in a cassette for convenience. Thus, the upstanding elements would include at least one cassette support pin for supporting the cassette. Preferably, first and second cassette support pins are provided at opposed sides of the baseplate to support the cassette.

When the printing substrate advancement means comprises means for rotating the rotatable platen, the upstanding elements would include a set of gear pins for receiving gears of a gear train operatively associated with the rotating means for driving the rotatable platen. Useful upstanding elements also include a cassette locating pin for locating the cassette relative to the baseplate, an ink ribbon sprocket support pin for supporting an ink ribbon sprocket for tensioning an ink ribbon, and a cutter mount with a cutter assembly for cutting the printing substrate. All these elements would be part of the unitary construction.

In a preferred embodiment, the printhead is movable between an operative position, in which it cooperates with the platen to print an image on the printing substrate or recording medium, and an inoperative position. To this end, the printhead support element may be a boss on which a printhead arm may be rotatably mounted. The printhead arm may be connected to a printhead support, which supports the printhead.

The present invention also relates to a printing device having a cassette receiving bay and a baseplate associated with the cassette receiving bay. The baseplate includes a flat base portion and a plurality of upstanding elements positioned at predetermined locations on the flat base portion. The flat base portion and upstanding elements together form a single part having a unitary construction.

The upstanding elements may include gear pins for receiving gears for driving the platen. The printing device may also include a cassette bay floor positioned on the gear pins over the gears. The cassette bay floor may be secured to the gear pins by securing means and are positioned to hold the gears in position on the gear pins.

The printing device may also include a cassette received in the cassette bay. The cassette is supported on the cassette support pins. The cassette includes the recording medium, which may be located at a predetermined spacing from the base portion of the base plate.

The printing device may also include a motor for driving the platen for rotation on a first axis. The motor rotates on a second axis which lies in a plane perpendicular to the first axis. A bevel gear may be associated with the motor to convert the rotation of the motor about the second axis to drive the platen about the first axis.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE DRAWINGS

Figure 1:
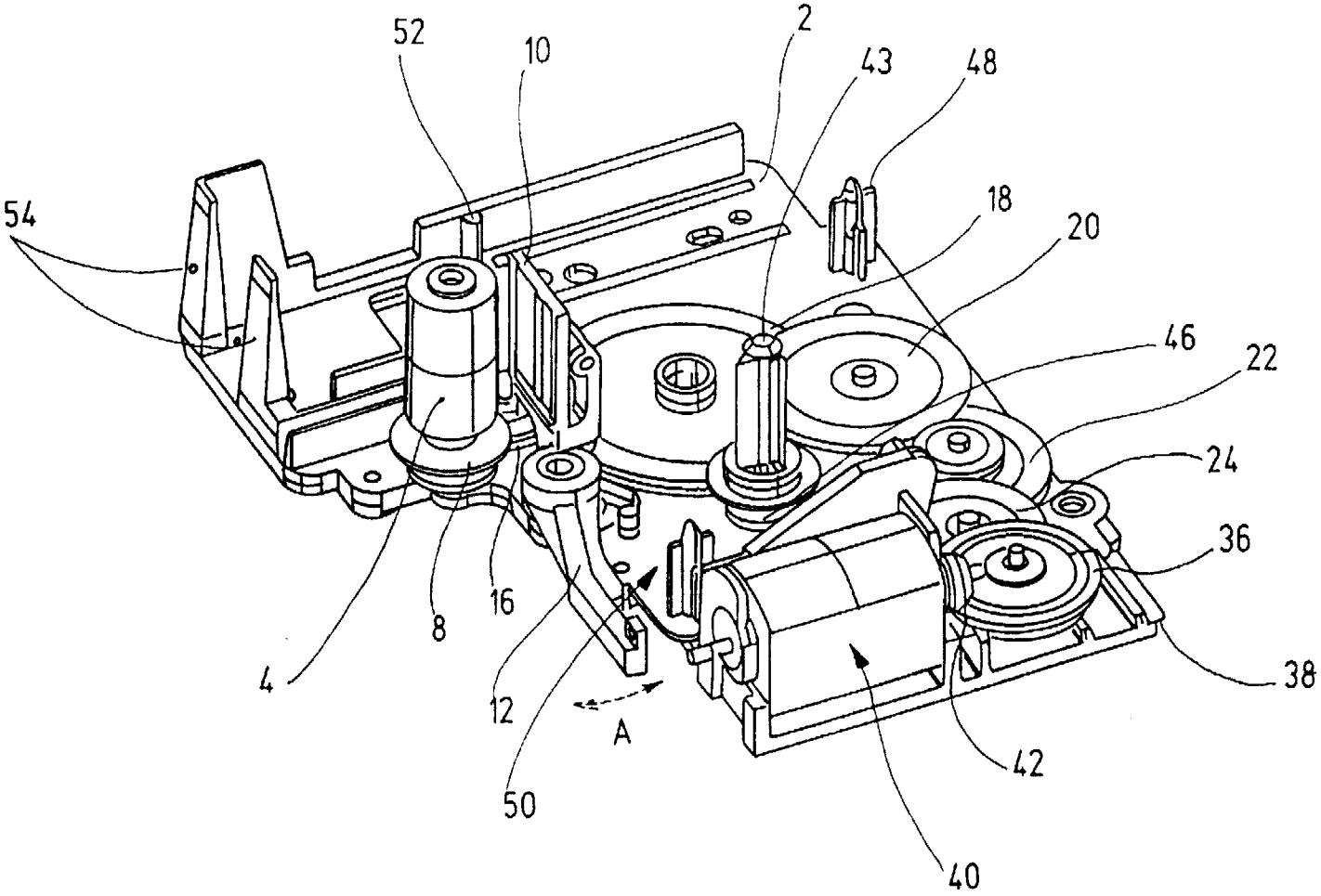
FIG. 1 is a perspective view of the main operating components within a cassette receiving bay of a printing device.

Referring to the drawings, wherein like reference numbers are used to designate like parts, FIG. 1 illustrates the main operating components arranged in the region of a cassette receiving bay of a printing device. Reference numeral 2 denotes a baseplate on which the operating components are mounted. The baseplate differs from conventional baseplates because it is manufactured as a single unit as will be described more completely herein.

The unitary baseplate of the present invention replaces a plurality of different, separate parts which are conventionally used in existing constructions. The cost is about one-third of the cost of conventional construction. In addition, a more reliable, more accurately dimensioned component part is obtained.

Figure 2:
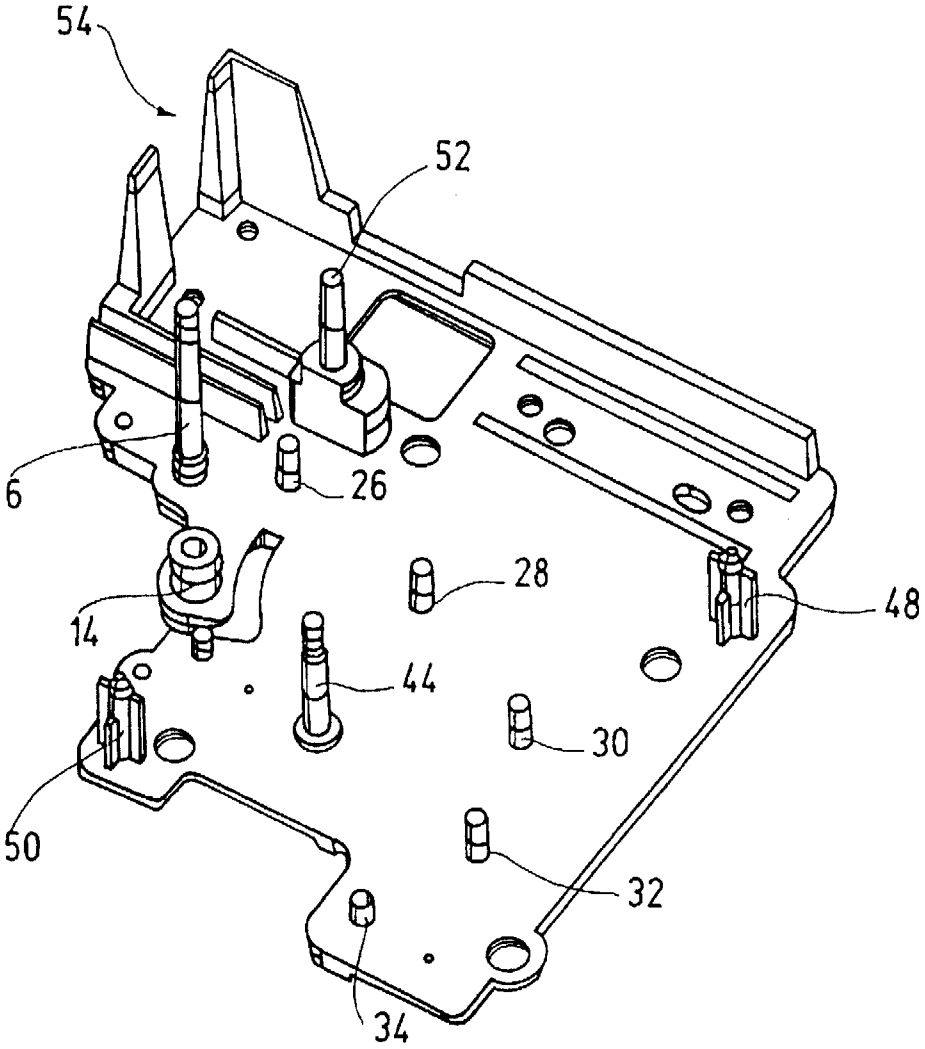
FIG. 2 is a view of a unitary baseplate of the present invention.

As shown in FIGS. 1 and 2, the baseplate 2 has a flat base portion and a plurality of upwardly extending pins for supporting the operating elements of the printing device.

A rotatable platen 4 is mounted on a platen support pin 6. A platen gear wheel 8 is also mounted for rotation relative to the platen support pin 6 and fixed to the platen 4 so that rotation of the platen gear wheel 8 causes the platen 4 to rotate about the platen support pin 6. A printhead support 10, is mounted on a printhead support arm 12 which is itself rotatably mounted on a boss 14. The support arm 12 can be moved in the direction of arrow A. A thermal printhead (not shown) is normally positioned on the printhead support 10. The thermal printhead has an array of selectively activatable printing elements preferably for printing an image. The support arm 12 is movable so that the thermal printhead can be placed selectively in an operative position in which the thermal printhead is pressed against the platen 4, and an inoperative position in which the printhead is moved away from the platen 4.

The platen gear wheel 8 is driven by a first spur gear 16 of a gear train consisting of five spur gears in total 18, 20, 22, 24. The spur gears in the gear train are supported respectively on spur gear support pins 26, 28, 30, 32 and 34. The final spur gear 24 in the gear train is driven by a horizontally oriented bevel gear 36. The horizontally oriented bevel gear 36 is located on a motor support plate 38. The motor support plate 38 also carries an electric motor 40 which is preferably a DC motor but may be a stepper motor of other suitable motor.

The motor is preferably arranged longitudinally with respect to the motor support plate 38, so that the plane of rotation is perpendicular to the plane of the baseplate. The motor drives a bevel gear 42 which is driven in a plane perpendicular to the plane of rotation of the horizontally oriented bevel gear 36 to drive bevel gear 36. Rotation of the bevel gear 36 drives the last spur gear 24 in the gear train and thus eventually, through the gear train, causes rotation of the platen 4. The platen 4 thus rotates about an axis perpendicular to the axis of rotation of the motor 40.

By using the motor to drive a bevel gear and converting the axis of rotation of the motor to a perpendicular axis to drive the platen, it is possible to fit a motor having a longer body into the confines of the cassette receiving bay. This allows a less expensive motor to be used.

An ink drive sprocket 43 is mounted on an ink drive sprocket pin 44, as shown in FIG. 1. An ink drive gear 46 attached to the ink drive sprocket is also mounted on the ink drive sprocket pin 44. The second gear 18 in the gear train causes rotation of the ink drive gear 46 and thus the ink drive sprocket 43. The function of the ink drive sprocket 43 will be explained in greater detail below.

The baseplate 2 also provides first and second cassette support pins 48,50. The baseplate 2 also provides a cassette support/alignment pin 52.

The baseplate also preferably includes a cutter mount 54 on which a cutter assembly is mounted. The cutter mount 54 is preferably part of the unitary baseplate. This avoids the need to manufacture a separate cutter mount component and reduces the complexity of the cutter assembly. As a result, the cutter blade alignment can be controlled accurately.

The baseplate, as illustrated in FIG. 2, is manufactured as a single, unitary part by die casting or by a plastic molding technique. The best way of implementing the manufacturing technique is dependent upon the details of the component. If die casting is used, zinc is a preferable material. The use of die casting, injection molding, or similar techniques, to produce the baseplate results in improvements over existing techniques for assembling baseplates, which are conventionally produced by inserting a plurality of upstanding member parts onto a base plate portion. Specifically, die casting, injection molding, and similar techniques result in consistently accurately placed and sized upstanding members and an overall consistently sized baseplate. It also results in a substantially lower cost for a higher quality product.

Generally, injection molding, including tooling costs and component costs, is less expensive than die casting and more widely available as a process. Injection molding is less accurate, however, and can result in a weaker component. Plastics are well suited for relatively small and simple unitary elements. To improve strength, glass-reinforced plastics can be used.

Moreover, manufacture of the baseplate can be automated with the present invention without a compromise of accuracy. The use of a single die casting step results in dimensions between upstanding elements which do not vary between baseplates. Also, the upstanding elements are more accurately dimensioned in size. This combines to produce a baseplate where the location of the printhead relative to the recording medium can be more accurately controlled.

Another technique for forming the baseplate is by outsert molding. In an outsert molding process, a flat base portion of the baseplate is joined to a plastic or similar conforming material by molding the plastic or similar material around the flat base portion. The various pins which protrude from the baseplate are added to the flat base portion by a single molding step. In this technique, the flat portion is preferably a metal plate.

Figure 3:
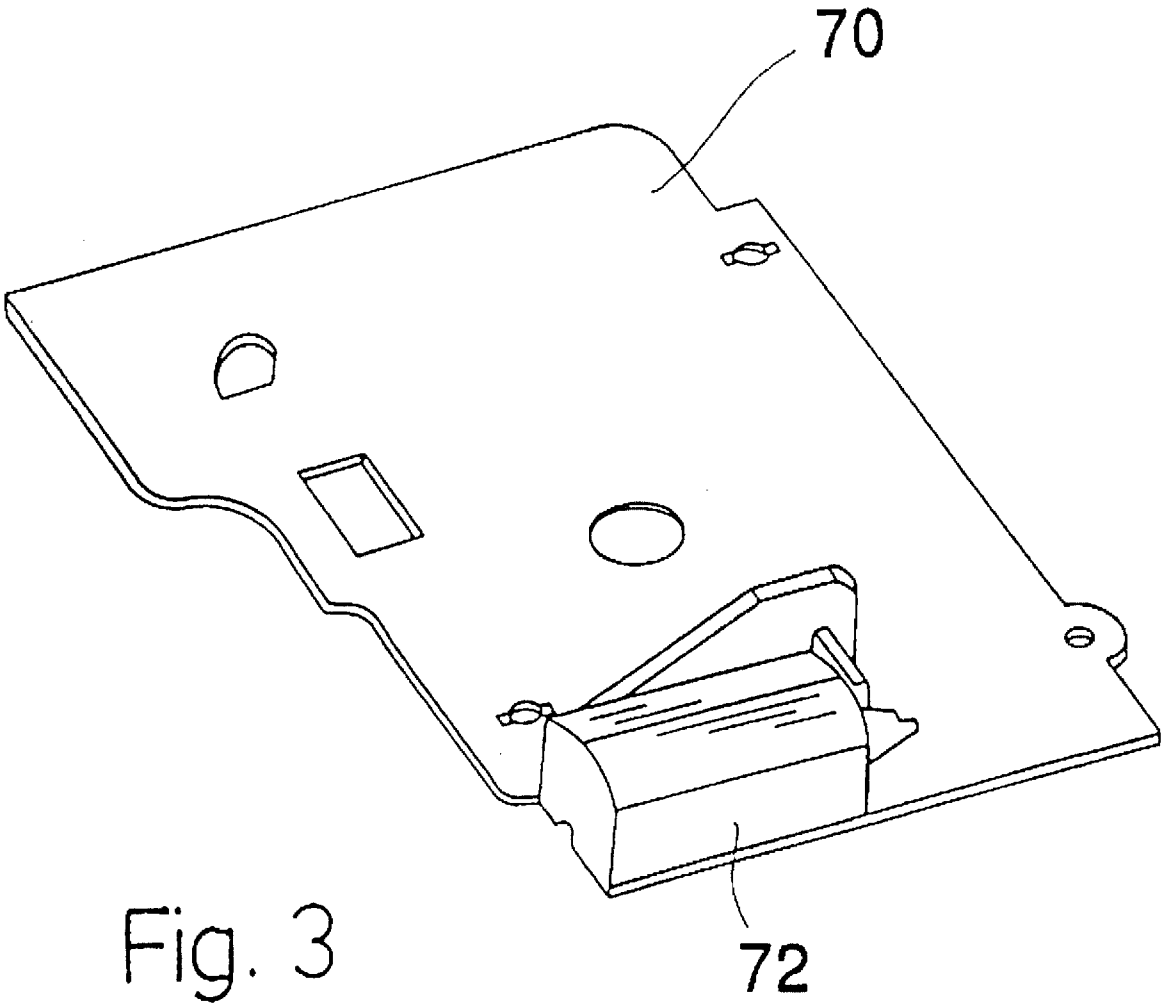
FIG. 3 is a view of part of the casework of a printing device.

The baseplate is preferably attached to the underside of casework defining the cassette receiving bay of the printing device. This casework is preferably provided by a plastic molding, which defines a cassette bay floor. Part of this molding is shown in FIG. 3. The cassette bay floor is denoted by reference numeral 70. The casework also incorporates a shroud 72 for the motor 40. The baseplate is secured to the underside of the cassette bay floor by screws or other appropriate means. The cassette bay floor thus extends over the gears 16 to 24 in the gear train, and the horizontally oriented bevel gear 36. The first and second cassette support pins 48,50, the ink drive sprocket 43, the platen 4, and the printhead support 10 protrude through the cassette bay floor 70. With this arrangement, the gears of the gear train are sandwiched between the baseplate and the casework. This obviates the need for circlips and retaining pins which would normally be required to secure the gears to their respective pins.

Figure 4:
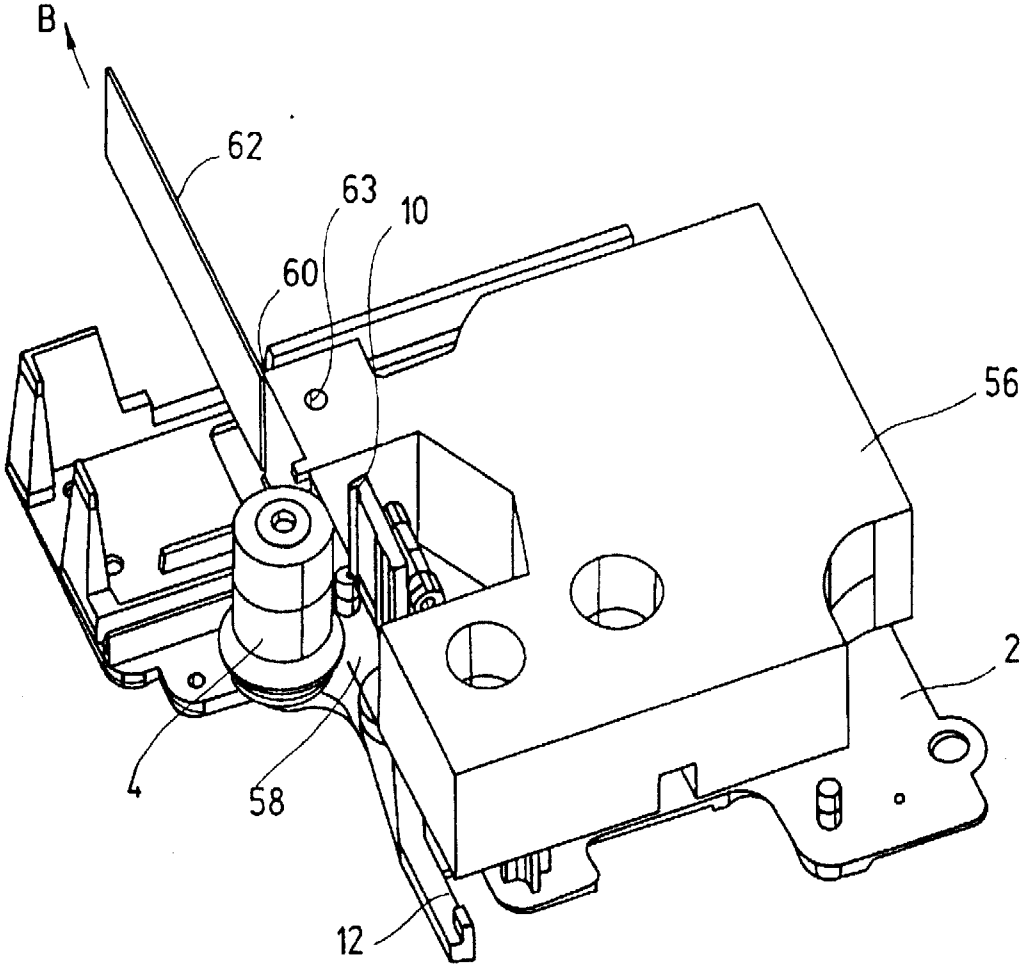
FIG. 4 shows the cassette receiving bay with a cassette loaded therein.

FIG. 4 shows the baseplate 2 with a cassette 56 positioned over the baseplate 2. The casework has been omitted for the sake of clarity. The cassette 56 is preferably a plastic case which holds a supply of ink ribbon which extends from a supply spool within the cassette, through a print zone 58 defined by the platen 4 and printhead in the printhead support 10 and onto a take-up spool within the cassette 56. The take-up spool can be driven by the ink drive sprocket 43 to tension the ink ribbon.

The cassette 56 also holds a supply of image receiving tape which extends from a supply spool within the cassette 56 through the print zone 58 in overlap with the ink ribbon and then out of the cassette through an exit portion 60 of the cassette 56. The image receiving tape is denoted by reference numeral 62 and comprises an upper layer for receiving a printed image, an adhesive layer on the opposite side of the upper layer, and a backing layer secured to the adhesive layer. In use, the backing layer can be peeled off to allow portions of the image receiving tape 62 to be secured to surfaces such as books and folders, for example, thereby forming a label.

The cassette 56 has on its underside two small recesses which respectively receive the first and second cassette support pins 48,50. The cassette 56 also has a through hole 63 for locating the cassette on the cassette support/alignment pin 52. Thus, the cassette is accurately located and aligned with respect to the baseplate 2. It does not sit on the casework itself but is spaced from it by the cassette support pins.

Operation of the printing device will now be described. As is known in the art, a label printing device includes an input means, for example a keyboard, for inputing data to be printed. A microprocessor controls operations of the printing device in accordance with data input at the keyboard. A display displays data input at the keyboard to assist a user in composing a label to be printed. The thermal printhead comprises a column of printing elements which extends widthwise of the tape 62. The printing elements are driven by the controller in accordance with data to be printed on a column by column basis. The platen 4 is rotated and this rotation causes the tape 62 to move in the direction of arrow B so that, between printing each column of pixels, the image receiving tape moves to an adjacent printing location. In this way, an image is formed on the tape. When the image of a whole label has been printed, a cutting assembly is activated to cut off the printed portion of the tape to provide an individual label.

To achieve good print quality, it is important to ensure that the printing elements of the thermal printhead print at accurate locations on the image receiving tape 62. The unitary baseplate described herein ensures this by providing accurate location of the cassette 56 and thus of the tape 62 with reference to the printhead.

The unitary baseplate provides for accurate positioning of the cassette support pins on the baseplate to allow for proper positioning of the cassette. In addition, the unitary baseplate 2 provides accurate positioning of the platen support pin 6 and of the print head boss 14. This results in accurate positioning of the platen roller 4 and the print head support 10. The platen roller 4 may consistently be positioned along an axis which is substantially perpendicular to the baseplate 2. The print head support 10 may, likewise, be consistently positioned so that the print head surface is substantially parallel to the surface of the platen roller 4. This obviates the need for compensatory springs, which are conventionally used to allow for slight variations in the position of the print head and platen roller.

It is also important that the print head be accurately positioned relative to the platen 4. Such accurate positioning requires that the print head pin and platen roller pin are accurately positioned and oriented. The straightness, parallelism and controlled diameter of the pins comprised in the unitary baseplate described herein, provides a significant advantage over the prior art.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A printing device comprising:

a baseplate having a substantially flat base portion and a plurality of upstanding elements positioned at predetermined locations on the base portion, wherein the base portion and the plurality of upstanding elements are together a single part of unitary construction;

a printer mounted on at least one of said upstanding elements for printinq on a printinq substrate;

a printing substrate support mounted on at least one of said upstanding elements for supporting a printing substrate; and a printing substrate advancement mechanism mounted on at least one of said upstanding elements for advancing a printing substrate through the printer.

2. The printing device of claim 1, wherein the printer comprises a printhead pivotably mounted on one of said upstanding elements.

3. The printing device of claim 2, wherein the upstanding elements further comprise an ink ribbon sprocket support pin for mounting an ink ribbon sprocket thereon for tensioning an ink ribbon used in printing.

4. The printing device of claim 1, wherein the plurality of upstanding elements include at least one cassette support pin for supporting a cassette that houses the printing substrate.

5. The printing device of claim 4, wherein the at least one cassette support pin includes first and second cassette support pins arranged at opposite sides of the flat base portion.

6. The printing device of claim 4, wherein the upstanding elements further include a cassette locating pin for locating the cassette thereon.

7. The printing device of claim 5, wherein the first and second cassette support pins are configured and dimensioned for supporting the cassette at a position above the flat base portion of the baseplate.

8. The printing device of claim 1, wherein the baseplate further comprises a cutter mount for mounting a cutter assembly thereon for cutting said printing substrate, said cutter mount being constructed as a unitary part of the baseplate.

9. The printing device of claim 1, wherein the baseplate is flat and has a coating thereon having a shape that defines said upstanding elements.

10. The printing device of claim 1, wherein the printing substrate support includes a rotatable platen rotatably mounted on one of said upstanding elements.

11. The printing device of claim 10, wherein the printing substrate advancement mechanism is configured for rotatably driving the rotatable platen.

12. The printing device of claim 11, further comprising a plurality of gears arranged in a gear train, each gear being rotatably mounted on one of said upstanding elements, wherein said gear train is operatively associated with the substrate advancement mechanism and the platen for rotating the platen.

13. The printing device of claim 11, wherein the baseplate has a side, the gear train and the platen being disposed on said side.

14. A printing device which comprises:

a cassette receiving bay; and a baseplate associated with the cassette receiving bay, said baseplate comprising a substantially flat base portion and a plurality of upstanding elements positioned at predetermined locations on said base portion, wherein the base portion and the plurality of upstanding elements are together a single part of unitary construction; and wherein the plurality of upstanding elements include a platen support element for supporting a rotatable platen.

15. A printing device which comprises:

a cassette receiving bay; and a baseplate associated with the cassette receiving bay, said baseplate comprising a substantially flat base portion and a plurality of upstanding elements positioned at predetermined locations on said base portion, wherein the base portion and the plurality of upstanding elements are together a single part of unitary construction, wherein the plurality of upstanding elements include:

a platen support element for receiving a rotatable platen;

a printhead support element for supporting a printhead; and at least one cassette support pin for supporting a cassette, which houses a recording medium on which an image is to be printed, at a predetermined spacing from the flat base portion of the baseplate.

16. The printing device of claim 15, wherein the plurality of upstanding elements of the baseplate further include a plurality of gear pins for receiving a plurality of gears to form a gear train arranged to rotate the platen.

17. The printing device of claim 16, which further comprises a cassette bay floor positioned on said gear pins over said gears and being secured by securing means to the baseplate to hold the gears in position.

18. The printing device of claim 15, wherein the printhead is movable between an operative position, in which it cooperates with the platen to print an image on the recording medium, and an inoperative position.

19. The printing device of claim 13, which further comprises:

a motor associated with said baseplate for rotating the platen about a first axis, wherein said motor has a rotor that is rotatable about a second axis which lies in a plane perpendicular to said first axis; and a bevel gear associated with said rotor for converting the rotation of the motor about the second axis to drive the platen about the first axis.

20. A printing device which comprises:

a cassette receiving bay; and a baseplate associated with the cassette receiving bay, said baseplate comprising a substantially flat base portion and a plurality of upstanding elements positioned at predetermined locations on said base portion, wherein the base portion and the plurality of upstanding elements are together a single part of unitary construction, and wherein the plurality of upstanding elements include a printhead support element adapted for supporting a rotatably mounted printhead.

* * * * *

UNITED STATES PATENT AND TRADEMARK OFFICE
CERTIFICATE OF CORRECTION

PATENT NO. : 5,709,486

DATED : January 20, 1998

INVENTOR : Robert Charles Lewis Day

It is certified that error appears in the above-identified patent and that said Letters Patent is hereby corrected as shown below:

Column 6, line 34: change both occurrences of "printinq" to --printing--.

Column 8, line 11: delete "by securing means".

Signed and Sealed this

Twenty-fourth Day of March, 1998

Bruce Lehman

*Attest:*

BRUCE LEHMAN

*Commissioner of Patents and Trademarks*

*Attesting Officer*